US006785982B2

(12) United States Patent
Yonkoski et al.

(10) Patent No.: US 6,785,982 B2
(45) Date of Patent: Sep. 7, 2004

(54) DRYING APPARATUS AND METHOD FOR DRYING COATED WEBS

(75) Inventors: Roger K. Yonkoski, Fairport, NY (US); Amy Schweighardt, Fort Collins, CO (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/164,996

(22) Filed: Jun. 7, 2002

(65) Prior Publication Data

US 2003/0226276 A1 Dec. 11, 2003

(51) Int. Cl.[7] ..... F26B 3/00
(52) U.S. Cl. ..... 34/463; 34/465; 34/633
(58) Field of Search ..... 34/633, 451, 463, 34/465, 623, 638

(56) References Cited

U.S. PATENT DOCUMENTS

| | | | | |
|---|---|---|---|---|
| 1,776,609 A | | 9/1930 | Andrews | |
| 3,982,328 A | * | 9/1976 | Gustafsson et al. | 34/641 |
| 4,365,423 A | | 12/1982 | Arter et al. | |
| 4,894,927 A | | 1/1990 | Ogawa et al. | |
| 4,999,927 A | | 3/1991 | Durst et al. | |
| 5,105,562 A | | 4/1992 | Hella et al. | |
| 5,524,363 A | * | 6/1996 | Seidl et al. | 34/629 |
| 5,621,983 A | * | 4/1997 | Lundemann et al. | 34/641 |
| 6,015,593 A | * | 1/2000 | Yonkoski et al. | 427/379 |
| 6,018,886 A | | 2/2000 | Bell et al. | |

OTHER PUBLICATIONS

Miller, C.A. and Neogi, P., Interfacial Phenomena, Marcel Decker, 1995.
Gutoff, E.b. and Cohen, D.C., "Modern coating and Drying Technology", J. Wiley and Sons, 1995, p. 289.

* cited by examiner

*Primary Examiner*—Ira S. Lazarus
*Assistant Examiner*—Kathryn S. O'Malley
(74) *Attorney, Agent, or Firm*—Mark G. Bocchetti; Paul A. Leipold

(57) ABSTRACT

A method and apparatus for drying a coated web is taught that reduces dryer induced mottle. The apparatus comprises a plurality of ducts positioned in series within an enclosure, the coated web travelling through the enclosure in a direction of travel, each duct including an arcuate portion terminating in a discharge nozzle, each discharge nozzle directed such that air exiting therefrom is flowing generally parallel to the coated web and in the direction of travel of the web; and at least one of the plurality of ducts having a baffle plate extending back therefrom toward another one of the plurality of ducts upstream thereof, the baffle plate being generally parallel to the coated web. Each duct preferably also includes a plate extension projecting from a bottom portion of the discharge nozzle in the direction of travel of the web, the plate extension being substantially parallel to the coated web.

12 Claims, 6 Drawing Sheets

DRYING APPARATUS AND METHOD FOR DRYING COATED WEBS

FIELD OF THE INVENTION

The present invention relates generally to drying of coated films and, more particularly, to drying methods and apparatus for minimizing mottle and creating a uniform drying atmosphere.

BACKGROUND OF THE INVENTION

One of the most common defects associated with organic solvent coatings is mottle. Direct impingement air can cause mottle by disturbing the coating. Also, the heat transfer uniformity is critical. Local variations in heat transfer can show up as mottle. Even if coatings are allowed to dry without direct air impingement, the shear forces caused by the web moving through still air can cause mottle. This will limit the speed at which a product can be manufactured. The occurrence of mottle is often cited as the single greatest limitation to productivity improvement in the drying of coated webs. In order to produce acceptable coatings, web speeds are often reduced significantly from what the machine is capable of coating and drying.

Mottle patterns can range from random and blotchy to "liney-streaky" depending on the coating and process conditions. Typically, in photographic film and paper, mottle becomes more severe and oriented in the direction of web travel as web speed is increased. Sensitive products can be limited to web speeds of around 150 feet per minute (fpm). Coatings can be made to be more robust to mottle by increasing the viscosity of the solutions and decreasing the wet thickness of the coating (concentrating the solution) such as described in Miller, C. A. and Neogi, P.; "Interfacial Phenomena"; Marcel Decker; 1995 but, this is not always possible because of coatability or solution stability concerns.

When the coating solutions cannot be made to be robust to mottle, disturbances to the coating created in the coating and drying machine must be minimized in order to produce acceptable coatings. One of the most important disturbances is air. Air can directly disturb a wet coating if the pressure or shear forces are great enough (Gutoff, E. B. and Cohen, D.C.; "Modern Coating and Drying Technology"; J. Wiley and Sons; p. 289; 1995). Even if the pressure and shear forces are not great enough to blow the coating around, non-uniformities in the air velocity impinging on the coating can cause surface tension driven flow. Surface tension driven flow arises as a result of variations in concentration and temperature along the surface of the coating. Non-uniform air flow can cause local variations in heat and mass transfer rates which in turn cause concentration and temperature variations.

In the last several years there have been only a limited number of published reports on the reduction of mottle by controlling air flow in a solvent coating machine. U.S. Pat. No. 4,365,423 to Arter et al. describes using two-layer screens very close to the coating to protect it from air disturbances and to raise the local solvent concentrations in the gas. U.S. Pat. No. 4,999,927 discloses another apparatus and method for drying a liquid layer that has been applied to a carrier material moving through a drying zone and which contains both vaporizable solvent components and non-vaporizable components. Dying gas flows essentially parallel to and in the direction of the carrier material and is accelerated within the drying zone in the direction of flow. In this manner, laminar flow of the boundary layer of the drying gas adjacent to the liquid layer on the carrier material is maintained. By avoiding turbulent air flow, mottle is reduced. U.S. Pat. No. 5,105,562 to Hella et al. describes a ventilating and impinging air bar assembly primarily for improved conveyance. However, this design relies on direct front side air impingement which is, in general, not desirable from the standpoint of minimizing mottle.

U.S. Pat. No. 4,894,927 describes a process for drying a moving web coated with a coating composition containing a flammable organic solvent. The web is passed through a closed-type oven filled with an inert gas and planar heaters on top and bottom of the web. The flow of drying gas is parallel but counter-current to the direction of web movement. The coating surface is reported to be barely affected by movement of the inert drying gases due to the small amounts of gas required. No discussion of the criticality of the gas flow system or of the need to prevent mottle is given.

Generally the drying of coated webs is accomplished by direct impingement of air from a nozzle wherein the air is supplied perpendicular to the place of the coated web. Using this technique, mottle occurs in the coating.

U.S. Pat. No. 1,776,609 to Andrews discloses a web drying apparatus that consists of nozzles which discharge heated air onto a deflector member. The air is discharged in the direction of the web and the discharge velocity is high to provide a large heat transfer. There is no mention of mottle control or matching of air velocity to web velocity.

U.S. Pat. No. 5,105,562 to Hella et al discloses a web drying apparatus which consists of a direct impingement air bar discharging air against the coated surface and a dilution air bar mounted on both sides of the impingement bar. This configuration provides both parallel (to the web travel) air flow and counter (to the web travel) air flow. The direct impingement and dilution bars are supplied air independently of each other. There is no mention of trying to match the air velocity to web velocity to control coating mottle.

U.S. Pat. No. 6,018,886 to Bell et al. teaches the use of curved nozzles to deliver air uniformly across the web width in the drying section. The air is delivered substantially parallel to the substrate surface and in the direction of the substrate movement. The goal was to deliver air at approximately the same velocity as the substrate speed. Although the average air velocity through the length of the drying section is close to the speed of the coated substrate through the drying section, the local air velocity can vary considerably along the length thereof. Even localized variability in the air velocity can lead to mottle.

SUMMARY OF THE INVENTION

It is an object of the invention to provide an apparatus and a method for drying coated webs without causing mottle.

It is a further object of the invention to substantially eliminate the shear effects that can be created by the coated web as it passes through the air in a dryer.

Briefly stated, the foregoing and other features, objects and advantages of the present invention will become readily apparent upon a review of the detailed description, claims and drawings set forth herein. These features, objects and advantages are accomplished by providing an improved configuration of the nozzles with the dryer over that taught in Bell et al. A minimum distance between the nozzle and the substrate surface is required to prevent periodic low and high regions of air velocity. An attachment plate is required to capture the air from the preceding nozzle and to further prevent the regions of low air velocity. This attachment plate is substantially parallel to the substrate surface.

DETAILED DESCRIPTION OF THE INVENTION

In the practice of the method of the present invention, a coating applied to the top side thereof is dried in a manner to reduce mottle. The substrate can be one of a variety of webs including, for example, polyethylene terephthalate (PET), polyethylene naphthalate (PEN), acetate, paper or metal. The coating is generally a solvent coating but the method of the present invention can be used in conjunction with aqueous based coatings as well. The present invention is particularly useful in reducing or eliminating mottle in coating compositions such as used for subbing layers for light sensitive emulsions, graphic arts films, and photographic films. Exemplary coating compositions include polymers (e.g.—polyvinyl butyral resin) and cellulose acetate, cellulose acetate butyrate, polymethyl methacrylate, and solvents such as methylene chloride, ketones (e.g.—methyl ethyl ketone), alcohols (e.g.—ethanol), toluene, and water. The coating compositions may also include dyes and surfactants.

Figure 1:
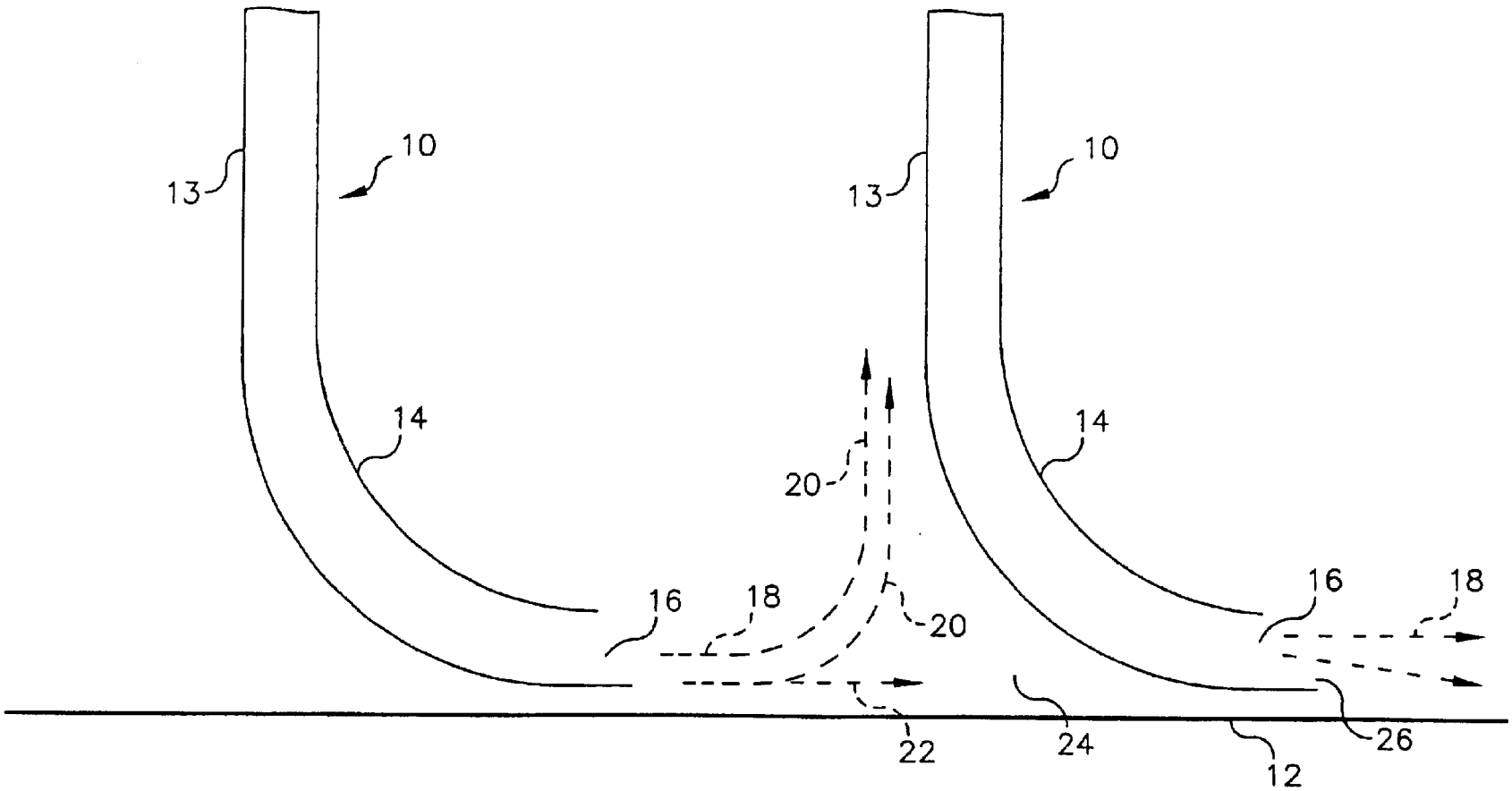
FIG. 1 (PRIOR ART)
FIG. 1 is a side elevational schematic of a prior art drier nozzle configuration.

Turning first to FIG. 1, there is shown a prior art nozzle configuration that typically results in an air velocity that varies strongly along the dryer path. Air flow is conducted through a plurality of conduits or ducts 10 in a dryer section through which the web or substrate 12 is conducted after a coating has been applied thereto. Each conduit or duct 10 includes a generally vertical section 13 and an arcuate section 14 terminating in a discharge nozzle 16. Arrows 18 are used to indicate air flowing from the discharge nozzles 16. As the air flow from one discharge nozzle 16 approaches the back side of the next conduit or duct 10 some of the air flow is diverted (as indicated by arrows 20) upwardly along the back side of the vertical section 13. Only a portion of the air flow (as indicated by arrows 22) can pass under the arcuate section 14 and nozzle 16 of that next conduit or duct 10. As a result, a region of low air velocity 24 occurs just at the back of the next conduit or duct 10. Further, when the arcuate section 14 is located too close to the substrate 12, a region of higher air velocity 26 occurs just down stream of the next discharge nozzle 16. Thus, although the average air velocity through dryer section using this prior art configuration approximate the velocity of the web, it can be seen that localized variability in the air velocity can still be present.

Figure 2:
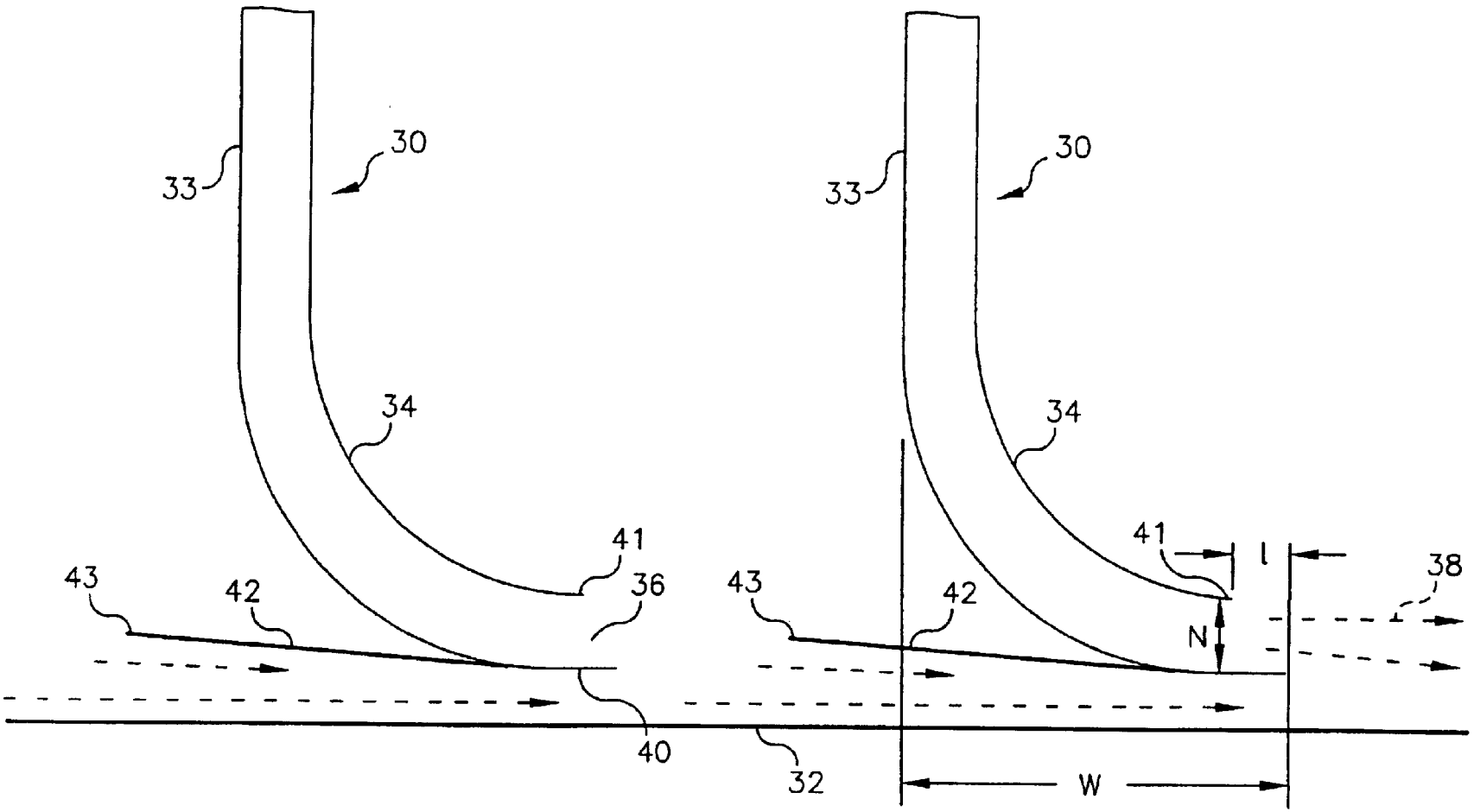
FIG. 2 is a side elevational schematic of a drier nozzle configuration of the present invention including a baffle extending therefrom.

Turning next to FIG. 2, there is shown one embodiment of the improved baffle arrangement of the present invention. Air flow is conducted through a plurality of conduits or ducts 30 in the a dryer section through which the web or substrate 32 is conducted after a coating has been applied thereto. Each conduit or duct 30 includes a generally vertical section 33 and an arcuate section 34 terminating in a discharge nozzle 36. Air flow (as indicated by arrow 38) from each discharge nozzle 36 is essentially parallel to the surface of the web or substrate 32. The discharge nozzle 36 includes a bottom lip plate extension 40 that extends beyond the top lip 41 of the nozzle 36. The bottom lip plate extension 40 is substantially parallel to the substrate 32 and aids in directing the air flow from the discharge nozzle 36 to be substantially parallel to the substrate 32 thereby minimizing the impingement of air onto the substrate 32. A plate baffle 42 extends from the arcuate section 34 of the conduit or duct 30. Baffle 42 captures a significant portion of the air delivered by the prior discharge nozzle 36 which is thereby caused to flow under the next conduit or duct 30. Baffle 42 is positioned to be generally parallel to the substrate 32. The lower portion of the arcuate section 34 of conduit 30 is spaced above the substrate 32 at a sufficient height to avoid the creation of a substantial resistance to flow. The height can be determined empirically. The bottom of discharge nozzle 36 is also placed at a height above the web 32 sufficient to minimize the impact of the impingement of air exiting from the discharge nozzle 36 on the surface of the substrate 32. The preferred spacing between the nozzle exit and the substrate is 1.5 to 6 inches, or more preferably 2.0 to 3.0 inches with air velocities in the range of from about 400 to about 1000 fpm. The air velocity should be set to minimize the difference between the air velocity and the velocity of the moving web.

The preferred ratio of the length of the attached baffle plate to the spacing between the nozzles is between 10 and 50 percent, or more preferred between 15 and 35%, or even more preferred between 20 and 30%. For example, the preferred length of the attached plate baffle 42, defined as the distance from where the plate baffle 42 diverges from the curve of the conduit 30 to the end 43 of plate baffle 42 is 4.0 to 12.0 inches. More preferably, the distance from where the plate baffle 42 diverges from the curve of the conduit 30 to the end 43 thereof is 6.0 to 8.0 inches.

As stated above, baffle plate 42 is positioned to be generally parallel to substrate 32 moving through the dryer section. The term "generally parallel" as used herein is intended to include the situation where the angle of the baffle plate 42 relative to the substrate 32 is ±5° from parallel. Positive angles may be defined as having the cantilevered end of the baffle plate 42 being further above the substrate 32 than the connection between the baffle plate and conduit 30. Preferably, the angle of the baffle plate 42 relative to the substrate 32 is ±2°. Most preferably, baffle plate 42 and substrate 32 are parallel. Further, although depicted as being planar, baffle plate 42 can also have a curved shape where the distance between the substrate 32 and baffle plate 42 increases as the further back the baffle plate 42 extends from the conduit 30.

The preferred spacing between nozzles from bottom lip plate extension 40 to bottom lip plate extension 40 is 1.5 to 4.0 feet, and more preferably 2.0 to 3.0 feet. The bottom lip plate extension 40 of each discharge nozzle 36 can be approximately the same length. As stated above, the bottom lip plate extension 40 extends beyond the top lip 41. Preferably, the ratio (l/h) of the length (l) of the bottom lip plate extension 40 to height (h) of discharge nozzle 36 is between 2.0 and 5.0 and, most preferably between 2.0 and 4.0.

Figure 3:
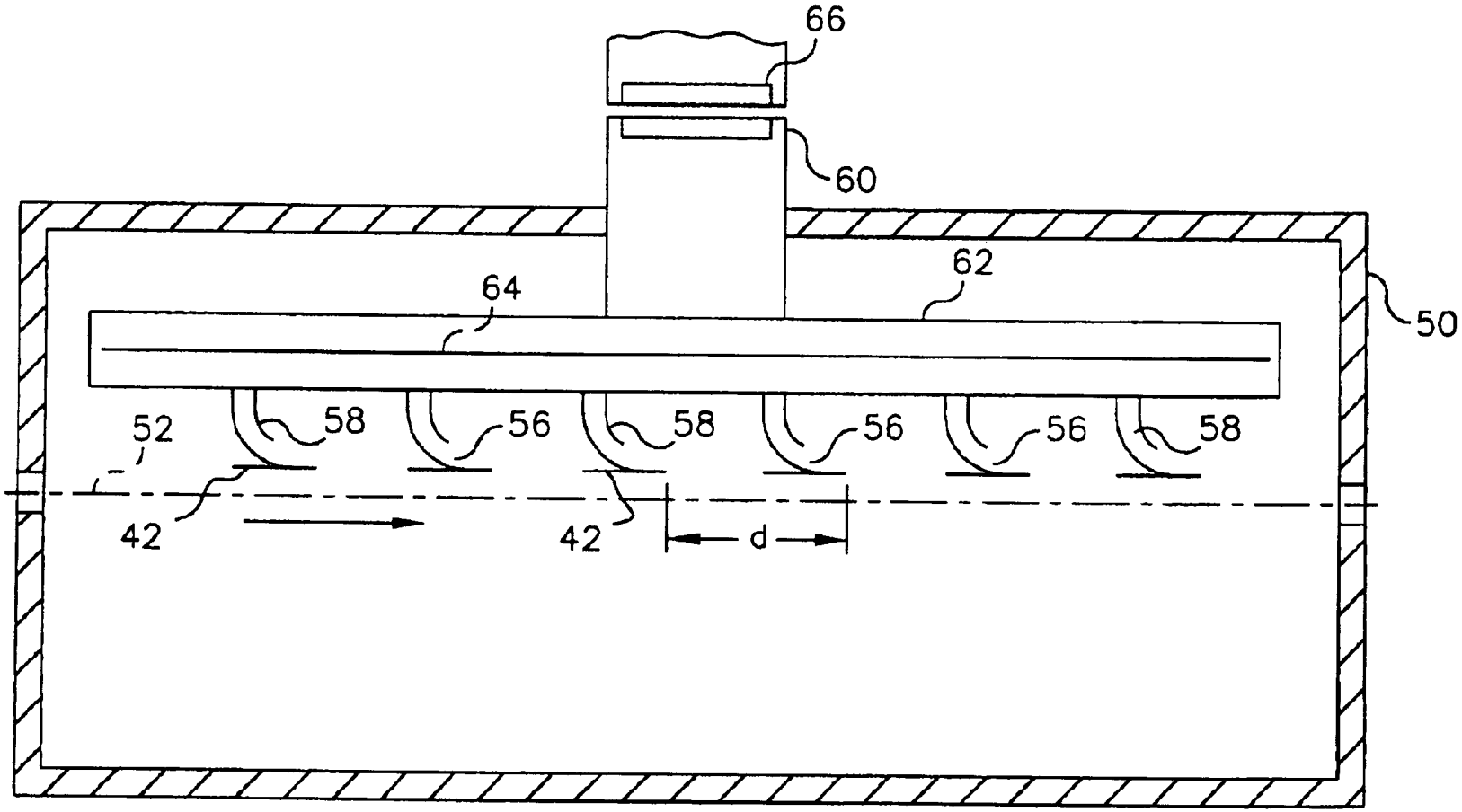
FIG. 3 is a schematic cross-sectional view of the dryer apparatus showing the nozzle arrangement therein.

Looking next at FIG. 3 there is depicted a schematic cross sectional view of a dryer enclosure 50. The conveyance system used to drive the coated web 52 therethrough is not shown, although it is preferred that the coated web be moving at a line speed above 400 fpm. The coated web 52 passes through the dryer enclosure 50 under the discharge nozzles 56 of conduits or ducts 58 (identical to ducts 30 of FIG. 2). Air is supplied to the discharge nozzles 56 via an air from primary supply air duct 60 which delivers air to a supply plenum 62. The conduits or ducts 58 are connected to the supply plenum 62. A perforated distribution plate 64 is used to ensure uniform air flow from the downstream discharge nozzles 56. The air pressure can be controlled by the pivoting air damper 66 in the primary supply air duct 60. This allows the same machine to coat a variety of products without sensitivity to dry point location.

Figure 4:
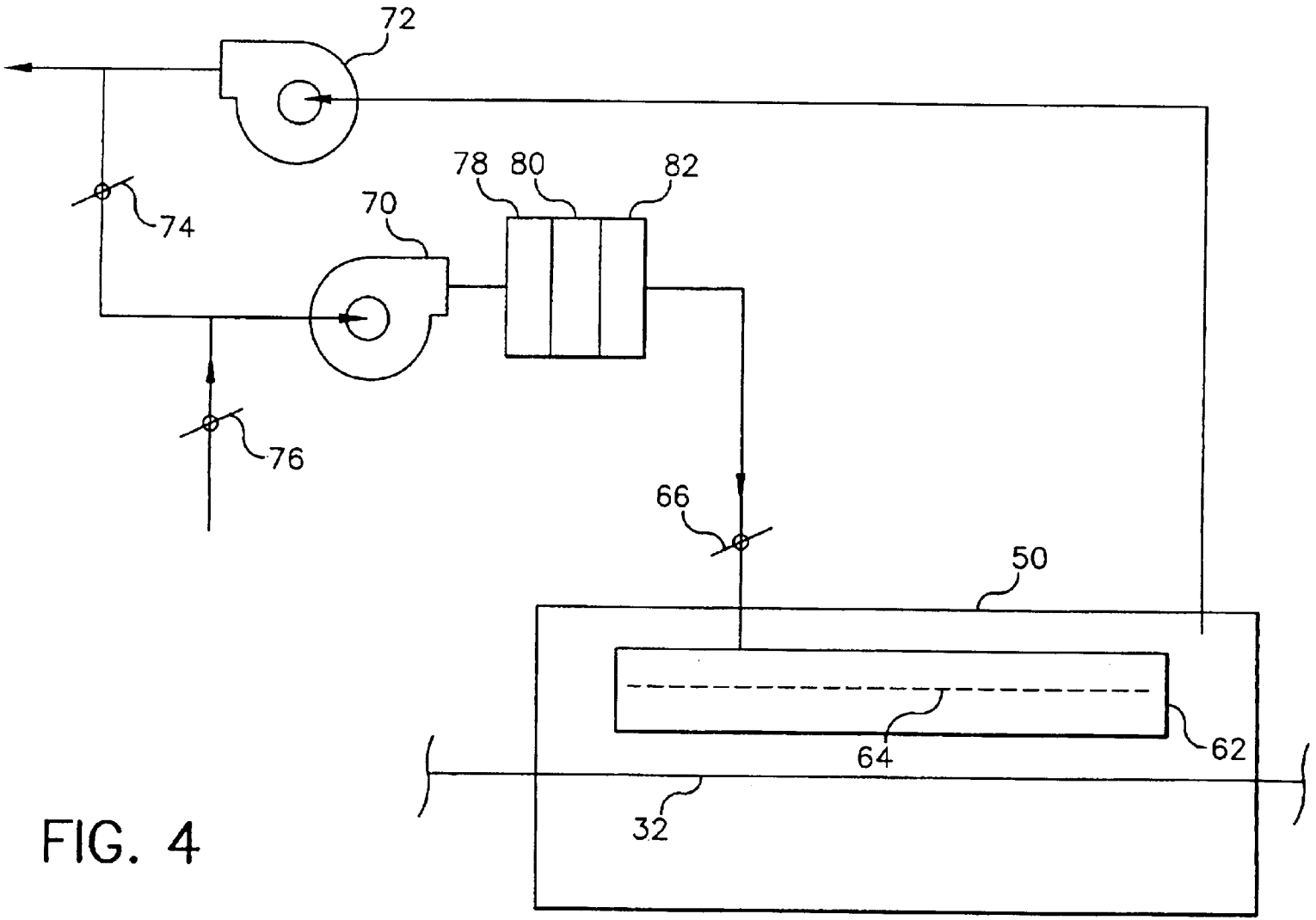
FIG. 4 is a schematic diagram process used in conjunction with the dryer apparatus shown in FIG. 3.

FIG. 4 illustrates the preferred process flow. Air is supplied by the supply air fan 70 which is obtained from an exhaust air fan 72 through a recirculate damper 74 assisted by a make-up air damper 76 and conditioned by either the cooling 78 or heating 80 coils, and then cleaned by the filters 82. It is often preferred to supply the air at temperatures between 2° C. and 150° C. The air pressure is controlled by the supply air damper 66. The air pressure is determined by the desired heat transfer rate and product sensitivity to coating mottle. Another factor in determining the air pressure is maintaining the solvent level in the enclosure 50 below the explosive limit. The supply air duct 60 delivers the air to supply air plenum 62. The air then passes through the perforated distribution plate 64 as shown in FIG. 3 to ensure uniform discharge velocities from the exit of the discharge nozzles 56 via ducts 58.

EXAMPLES

Figure 5:
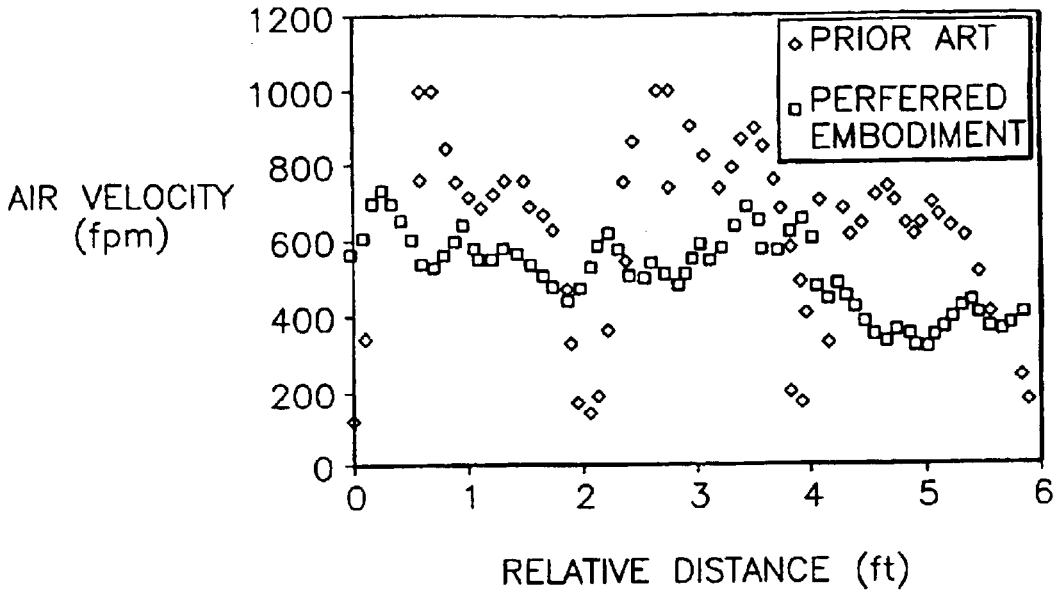
FIG. 5 is a graph plotting the air velocity versus distance from one nozzle exit for the configuration of the present invention and the prior art configuration, which demonstrates the ability of the present invention to deliver an improved air velocity profile through the dryer section as compared to the prior art apparatus.

Looking next at FIG. 5 a graph is presented which demonstrates the ability of the present invention to deliver an improved air velocity profile through the dryer section as compared to the prior art apparatus of FIG. 1. The different configurations are described in Table 1. The prior art data was generated with a configuration that included a bottom lip plate extension. The present invention delivers a significantly smoother air velocity profile as compared to the prior art configuration.

TABLE 1

| Attribute | Preferred Embodiment | Prior Art with Bottom Lip plate extension |
|---|---|---|
| Nozzle-to-Substrate Spacing (inches) | 3 | 1 |
| Plate Attachment Length (in) | 7 | (none) |
| Plate Angle (relative to substrate) | 0° | (none) |
| Spacing between Nozzles (ft) | 3.0 | 2.0 |
| Bottom Lip plate extension (in) | 2.0 | 2.0 |
| Nozzle Slot Opening (in) | 1.0 | 1.0 |

Figure 6:
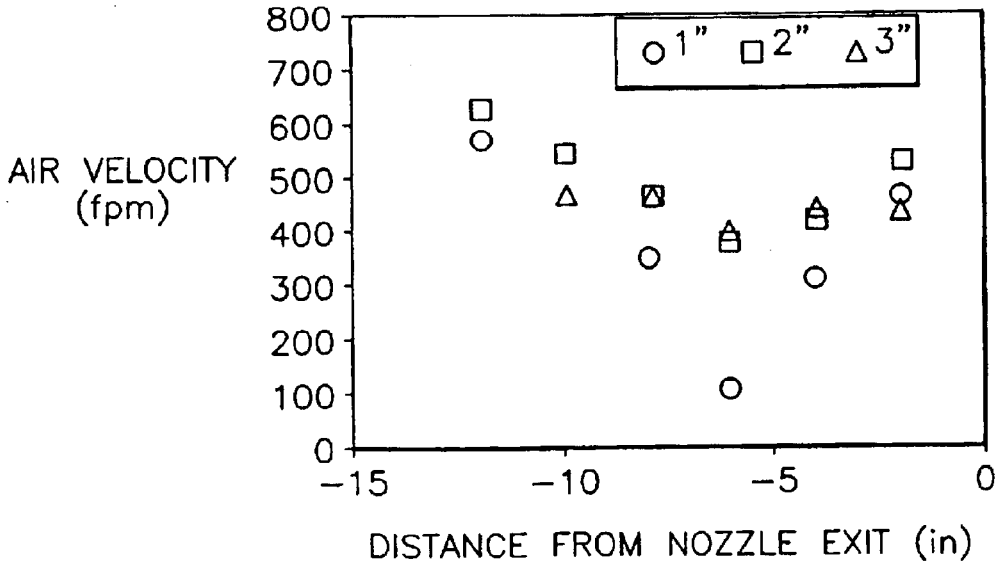
FIG. 6 is a graph plotting the air velocity versus distance from the nozzle exit using the dryer and nozzle configuration of the present invention showing the effect of increasing the distances between the bottom of the discharge nozzle and the surface of the web.

FIG. 6 illustrates the effect of increasing the distances between the lip plate extension 40 and the surface of the substrate 32. The discharge nozzles 36 were spaced at a distance (d) (see FIG. 3) of 2 feet with no baffle plate 42 used. The air velocity measurements are shown at the distance from the exit if the lip plate extension 40. The negative values indicate positions upstream of the lip plate extension 40 of a particular discharge nozzle 36 while positive values indicate positions downstream of the lip 40 of that particular discharge nozzle 36. The width (w) of conduit 30 from the rear surface of vertical section 33 to the bottom lip plate extension 40 was 5 inches. At a 1 inch spacing between the bottom of each discharge nozzle 36 and the substrate 32 there is a significant drop in the air velocity at approximately −6 inches, which is near the back end of the nozzle. When the substrate-to-nozzle spacing is increased to 2 inches and 3 inches, the minimum is suppressed. The difference between the 2 inch and 3 inch spacing is small compared to the benefit seen from increasing from 1 inches to 2 inches.

Figure 7:
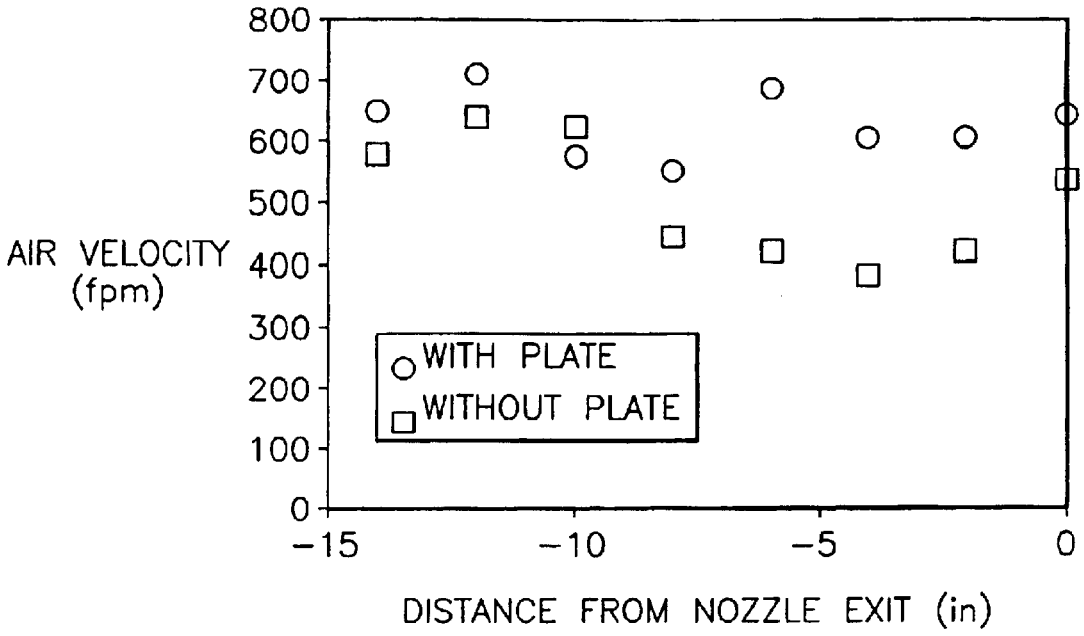
FIG. 7 is a graph plotting the air velocity versus distance from the nozzle exit using the dryer and nozzle configuration of the present invention and the prior art configuration.

FIG. 7 illustrates the advantageous effect of the baffle plate 42. The discharge nozzles 36 were placed 2 feet apart and at a 2 inch spacing from the substrate 32. The baffle plate 42 was 6 inches long. The width (w) was 5 inches (see FIG. 2). The baffle plate 42 was oriented parallel to the substrate 32. The baffle plate 42 acts to suppress the minimum in the air velocity profile under the arcuate portion 34 of the duct 30.

Figure 8:
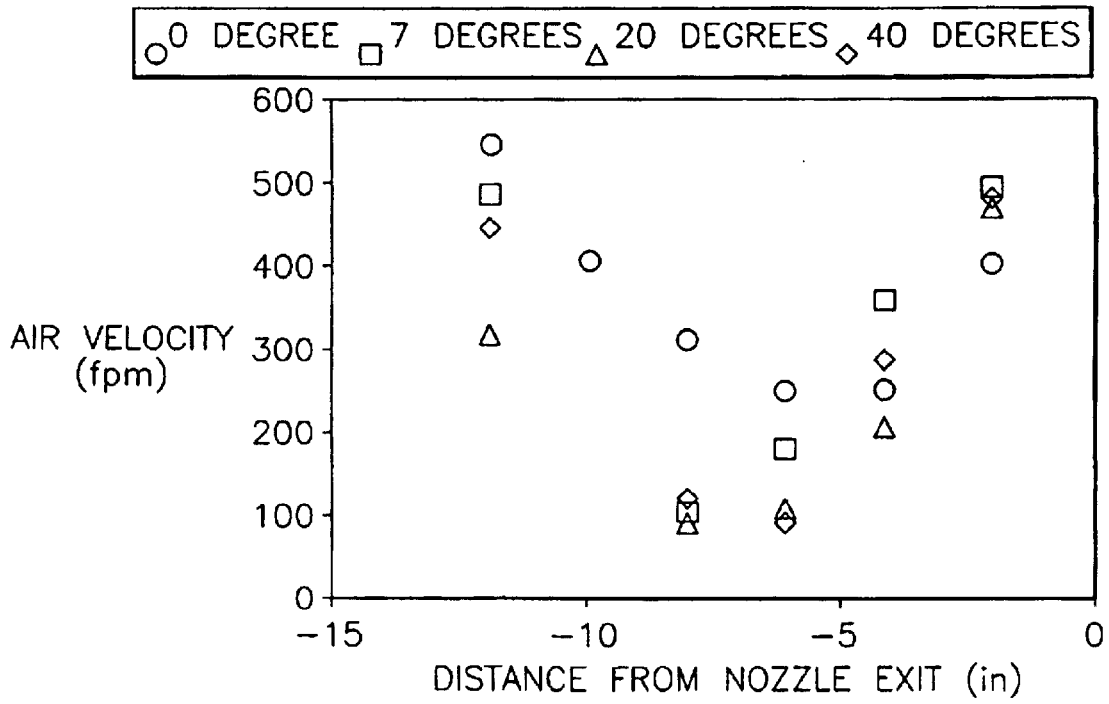
FIG. 8 is a graph plotting the air velocity versus distance from the nozzle exit using the dryer and nozzle configuration of the present invention for baffle plates that are parallel to the web, and baffle plates that are angled upward at angles of 7°, 20°, and 40° with respect to the plane of the web.

FIG. 8 illustrates the effect of the angle of the baffle plate 42 relative to the substrate 32. The height of the discharge nozzles 36 was 1 inch off the surface of the substrate 32 and the discharge nozzles 36 were spaced 2 feet apart. The baffle plate 42 used was 4 inches long. When the baffle plate 42 was parallel to the substrate 32, the minimum in air velocity was suppressed. When the baffle plate 42 was set at angles 7 to 40 degrees relative to the substrate 32, the minimum in the air velocity profile was considerably larger.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

| | |
|---|---|
| 10 | ducts |
| 12 | web or substrate |

-continued

| | |
|---|---|
| 13 | vertical section |
| 14 | arcuate section |
| 16 | discharge nozzle |
| 18 | arrow |
| 20 | arrow |
| 22 | arrow |
| 24 | lower air velocity |
| 26 | higher air velocity |
| 30 | conduit or ducts |
| 32 | web or substrate |
| 33 | vertical section |
| 34 | arcuate section |
| 36 | discharge nozzle |
| 38 | arrow |
| 40 | bottom lip plate extension |
| 41 | top lip |
| 42 | baffle place |
| 43 | end |
| 50 | dryer enclosure |
| 52 | coated web |
| 56 | discharge nozzle |
| 58 | conduits or ducts |
| 60 | air duct |
| 62 | supply plenum |
| 64 | perforated distribution plate |
| 66 | pivoting air damper |
| 70 | supply air fan |
| 72 | exhaust air fan |
| 74 | recirculate damper |
| 76 | make up damper |
| 78 | cooling coils |
| 80 | heating coils |
| 82 | filters |

What is claimed is:

1. An apparatus for drying a coated web comprising:

(a) a plurality of ducts positioned in series within an enclosure, the coated web traveling through the enclosure in a direction of travel, each duct including an arcuate portion terminating in a discharge nozzle, each discharge nozzle directed such that air exiting therefrom is flowing generally parallel to the coated web and in the direction of travel of the web; and (b) at least one of the plurality of ducts having a baffle plate extending back therefrom toward another one of the plurality of ducts upstream thereof, the baffle plate being generally parallel to the coated web, wherein:

each baffle plate has a length that is related to a spacing between adjacent discharge nozzles such that a ratio of the length of each baffle plate to the spacing is from about 10 to about 50%.

2. An apparatus as recited in claim 1 further comprising:

a plate extension projecting from a bottom portion of the discharge nozzle in the direction of travel of the web, the plate extension being substantially parallel to the coated web.

3. An apparatus as recited in claim 1 wherein:

the baffle plate is angled from the plane of the web by an angle of not more than 5°.

4. An apparatus as recited in claim 1 wherein:

the web is traveling at speed in the range of from about 400 to about 1000 fpm.

5. An apparatus as recited in claim 1 wherein:

a bottom surface of each of the plurality of ducts is spaced apart from the web by from about 1 inch to about 3 inches.

6. An apparatus as recited in claim 1 wherein:

a bottom surface of each of the plurality of ducts is spaced apart from the web by from about 2 in. to about 3 in.

7. An apparatus as recited in claim 2 wherein:

the plate extension has a length l and the discharge nozzle has a height h, and the ratio (l/h) is between 2.0 and 5.0.

8. An apparatus as recited in claim 2 wherein:

the plate extension has a length l and the discharge nozzle has a height h, and the ratio (l/h) is between 2.0 and 4.0.

9. An apparatus as recited in claim 1 wherein:

the web is traveling at speed of at least about 400 fpm.

10. An apparatus as recited in claim 1 wherein:

each baffle plate has a length that is related to a spacing between adjacent discharge nozzles such that a ratio of the length of each baffle plate to the spacing is from about 15 to about 35%.

11. An apparatus as recited in claim 1 wherein:

each baffle plate has a length that is related to a spacing between adjacent discharge nozzles such that a ratio of the length of each baffle plate to the spacing is from about 20 to about 30%.

12. An apparatus as recited in claim 4 wherein:

the air is emitted from each of the discharge nozzles at a velocity that approximates the speed that the web is traveling.

* * * * *